United States Patent [19]

Fatuzzo et al.

[11] 4,263,061

[45] Apr. 21, 1981

[54] PROCESS FOR FORMING A HIGH RESOLUTION X-RAY INTENSIFYING SCREEN WITH ANTIREFLECTING SUBSTRATE

[75] Inventors: Carol L. Fatuzzo, Pine Springs, Minn.; George D. Foss, River Falls, Wis.

[73] Assignee: Minnesota Mining and Manufacturing Company, Saint Paul, Minn.

[21] Appl. No.: 89,881

[22] Filed: Oct. 31, 1979

Related U.S. Application Data

[62] Division of Ser. No. 890,673, Mar. 27, 1978, Pat. No. 4,204,125.

[51] Int. Cl.[3] ..... H01J 1/62

[52] U.S. Cl. ..... 148/6.3; 427/65; 250/483

[58] Field of Search ..... 250/483, 486; 148/6.27, 148/6.3

[56] References Cited

U.S. PATENT DOCUMENTS

| | | | |
|---|---|---|---|
| 3,783,297 | 1/1974 | Houston | 250/483 |
| 3,917,950 | 11/1975 | Carlson | 250/483 |
| 4,011,454 | 3/1977 | Lubowski et al. | 250/483 |
| 4,013,465 | 3/1977 | Clapham et al. | 350/276 R |
| 4,090,085 | 5/1978 | Shimiya et al. | 250/483 |
| 4,148,077 | 1/1980 | Washida | 250/483 |
| 4,190,321 | 2/1980 | Dorer | 350/165 |

*Primary Examiner*—Ralph S. Kendall

*Attorney, Agent, or Firm*—Cruzan Alexander; Donald M. Sell; William B. Barte

[57] ABSTRACT

A process is disclosed whereby there is formed a high resolution screen in which laterally directed back reflections of light produced within a luminous layer, which reflections have heretofore been generally laterally directed so as to result in decreased resolution, are minimized by the inclusion of an antireflecting surface at the back side of the luminous layer. In the present process, the antireflecting surface is formed by subjecting a substantially planar aluminum surface on a support layer to a steam treatment to convert the aluminum surface to a microstructured surface of boehmite, a hydrated aluminum oxide, having a plurality of randomly positioned leaflets extending from the surface.

3 Claims, 3 Drawing Figures

PROCESS FOR FORMING A HIGH RESOLUTION X-RAY INTENSIFYING SCREEN WITH ANTIREFLECTING SUBSTRATE

This is a division of application Ser. No. 890,673 filed Mar. 27, 1978, now issued as U.S. Pat. No. 4,204,125.

BACKGROUND OF THE INVENTION

1. Field of the Invention

This invention relates to luminescent devices which typically include a laminate of a number of planar layers, one of which has a fluorescent material such as phospor particles for directly modifying electromagnetic radiation directed thereat into luminous energy.

2. Description of the Prior Art

Image intensifying screens are frequently used to convert images contained in radiation of a given wavelength such as x-rays into another wavelength more suitable for a given use, such as visible light for fluroscopy, and UV or like wavelengths within the spectral sensitivity range of films for radiography. Such screens typically include a backing or support layer of paper, metal or plastic which is transparent to the incoming radiation, a light reflecting coating, luminous layer composed of the finely divided phosphor particles embedded in a plastic matrix, and a light transparent plastic protective layer.

Such an image intensifying screen functions as follows: energy dissipated in phosphor particles within the luminous layer subsequent to the interaction with a source of radiation such as x-rays is converted into a number of light photons which are emitted in all directions. Most of the photons directed toward the exit face of the screen pass therethrough such that they may impinge on a light sensitive medium positioned adjacent the screen to form a latent image therein which corresponds to the spatial distribution of radiation dissipated within the luminous layer. Other photons directed toward the back face may be reflected by the reflective coating toward the exit face such that they also pass therethrough and hence add to the initially forward directed photons, thereby increasing the speed or effective efficiency of the screen. Laterally directed photons are ultimately diffused within the phosphor layers, as a result of multiple scattering and eventual absorption. Preferably, the phosphor material is provided in particulate form to minimize the lateral diffusion of the photons, and consequent loss of resolution of the converted image.

"Speed" and "resolution" are two factors which characterize the performance of such screens. Speed is a measure of the number of light photons exiting the face of the screen for a given amount of energy impinging upon it, while resolution is a measure of the ability of the screen to faithfully reproduce an image contained in the radiation source.

Structural features of the screens which contribute to speed generally conflict with those required for good resolution, such that screen constructions must compromise between speed and resolution, leaning toward one or the other depending upon the demands of intended applications. High-speed, low resolution screens have thick phosphor layers with large particles, and generally include a light reflecting coating to reflect photons toward the exit face, thereby increasing the effective speed of the screen.

In contrast, high resolution screens are generally provided with some means of inhibiting reflections from the back face of the luminous layer, such that photons emitting toward the rear face are lost, thereby resulting in a slower effective speed.

For example, in U.S. Pat. No. 3,917,950 (Carlson) there is depicted a flourescent screen in which a carbon black light absorbing layer is provided on the back side of a flourescent layer to improve resolution, at the expense of intensity. In U.S. Pat. No. 3,783,297 (Houston) there is depicted an x-ray intensifier device including a waffle-like support structure in which the floor of the structure is reflective and the sides are absorbant. The reflective floor is intended to reflect normally directed light, thereby intensifying the desired light, while laterally directed light is absorbed by an absorbing material, thereby minimizing the lateral spreading of light. That patent also suggests that a jagged surface on an Al face plate, such as may be formed by etching may also be employed to serve a similar function. U.S. Pat. No. 4,011,454 (Lubowski et al) depicts an alternate embodiment of a waffle-like structure included in an x-ray screen to inhibit lateral spreading of light, in which the phosphor layer itself is deposited in columns. Laterally directed light is thus reflected or contained within each column.

SUMMARY OF THE INVENTION

In contrast to prior art high resolution screens in which macrostructured absorbing layers or elements are provided, the present invention is directed to a screen in which a microstructured surface is included at the inner face of a fluorescent layer. Such microstructured surfaces are known to be provided on the outer surfaces of optical elements, and are effective in minimizing reflections of light directed toward the surface so as to improve the transmission of light through, or the absorption of light within, the optical elements. Such microstructures surfaces have not heretofore been considered when the reflection of light within an optical element itself is to be minimized.

The screen of the present invention is adapted for converting one form of electromagnetic radiation, typically imaged x-rays, into light which may then be directed to expose a light sensitive medium. The screen comprises a luminous sheet having an antireflecting surface thereon characterized by a plurality of small, generally long and thin protuberances generally extending normal to the surface a distance not greater than about 1000 nm, the average amplitude of which is not less than 100 nm and which have an average peak-to-peak spacing therebetween of not less than 20 nm. Such protuberances are believed to act as a graded index of refraction to substantially prevent light emitting within the sheet and directed toward the antireflecting surface from being either diffusely or specularly reflected, and thus inhibits reflected radiation from passing back through the sheet. The lateral spreading of emitted light is thus minimized, resulting in a significant increase in the resolution with which an image in said one form of electromagnetic radiation is imaged by the corresponding emitted light onto the photosensitive medium.

In a preferred embodiment, the screen includes a flexible, x-ray permeable, support and has the antireflecting surface sandwiched between the support and the luminous sheet. The support may be virtually any sheet-like member and may be formed of a wide variety of materials. It may be transparent or non-transparent, and may be rigid or flexible. In one form, the screen is desirably flexible, hence the support is a relatively flexible sheet, such as a section of metal (Al) foil or polymeric web. The luminous sheet is desirably of conventional construction, and may include a typical x-ray sensitive phosphor such as $Gd_2O_2S$:Tb or $CaWO_4$ particles mixed with an organic binder knife-coated onto the support to provide a sheet typically 75 μm thick.

The antireflecting layer of the screen of the present invention is preferably formed of boehmite, a hydrated oxide of aluminum, characterized by a plurality of closely spaced and randomly positioned discrete leaflets of varying heights and shapes, which leaflets extend from the support layer a distance of not less than approximately 20 nm, but in which the average amplitude is not less than 100 nm. In such a construction, the bases of the leaflets contact the bases of substantially all adjacent leaflets to provide the antireflection layer with a total reflectance of normally incident light of less than one percent.

Preferably, the antireflecting layer is formed by first providing a support layer having a substantially planar surface of substantially non-oxidized aluminum. Such a surface may be provided as an intrinsic portion of the support layer, as in the case of an Al foil support, or may be provided as a deposit of a thin-film of Al, such as on a transparent web of polymeric material. The Al surface layer is then converted to boehmite by exposing the layer to steam at a temperature between 85° and 98° C. at atmospheric pressure for 5–15 minutes. The boehmite antireflecting layer is then preferably overcoated with a layer of any suitable phosphor/binder mixture to form the luminous sheet. If desired, a protective topcoat may also be provided.

In an alternative embodiment, the luminous sheet may be formed to have the antireflecting surface directly thereon. According to the present invention, such a sheet may be formed by depositing a thin-film of Al directly onto one surface of the luminous sheet, after which the thin-film is converted to the boehmite layer as described hereinafter. Also, such or similar microstructured surfaces may be embossed directly into the surface of the sheet, or the sheet may be coated upon a support having such a surface, after which the support may be removed.

Such a screen is particularly suited for utilization with an x-ray source together with photographic film, and functions excellently to convert an x-ray image from the source into an optical image which may then be imaged onto the film in a conventional manner.

Similarly, by appropriate selection of the materials in the fluorescent layer, other types of radiation images, such as neutron images, electron images, etc., may also be more faithfully, i.e., with higher resolution, converted into optical images. Such an alteration may likewise make desirable other changes in the support layer and the like; however, the role and characteristics of the antireflecting surface would remain unchanged.

While the primary advantage of the microstructured boehmite layer is the antireflective property which results in the desirable high resolution in resulting images, a further advantage is also afforded in that the microstructured surface provides an excellent priming surface. This priming feature promotes excellent adhesion between the support layer and the flourescent layer for a wide variety of constructions, and thereby results in screens with significantly improved physical properties.

DESCRIPTION OF THE PREFERRED EMBODIMENTS

Figure 1:
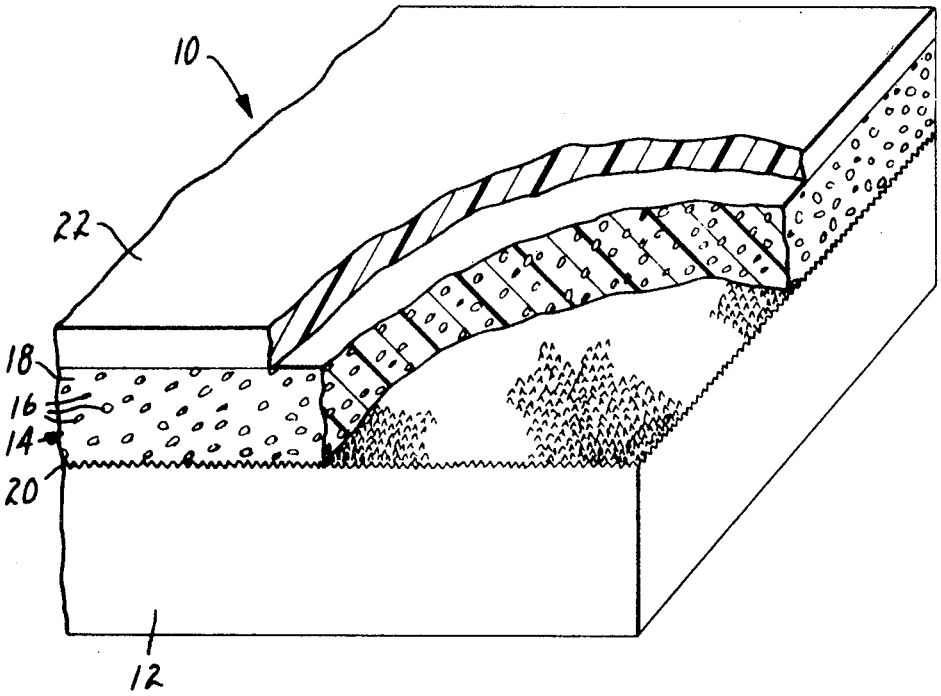
FIG. 1 is a cut-away perspective view of one embodiment of the screen of the present invention.

FIG. 1 shows a cut-away view of a preferred embodiment of the screen 10 according to the present invention. In this embodiment, the screen 10 includes a support layer 12, a luminous sheet consisting of a fluorescent layer 14 containing a mixture of fluorescent particles 16 in a polymeric binder 18, an antireflecting layer 20 between the support layer 12 and the fluorescent layer 14 and finally, a protective top sheet 22.

The support layer 12 may be formed of a variety of materials. Where the incident radiation is directed onto a photographic medium and thence onto the front surface of the screen, the support layer need not be and may preferably not even be permeable to the radiation. Contrariwise, if radiation is directed first through the support layer, it must be formed of a material permeable to the radiation to be intensified by the screen. X-ray permeable materials include opaque as well as transparent materials, and may be low mass metal foils, insulators such as glass or plastic sheets, etc. In the preferred embodiment shown in FIG. 1, such a sheet is preferably a 200 μm (8 mil) sheet of aluminum foil. Aluminum sheets suitable for use in offset lithography work are particularly desirable. The starting sheets are normally cut to dimensions of 25.4 cm by 50.8 cm to accommodate the processing equipment. If necessary, the aluminum sheet is cleaned with 600 grit silicon carbide "Wet Or Dry" Brand abrasive sheets, manufactured by Minnesota Mining and Manufacturing Company, wetted with a strong detergent solution. The grinding residue and detergent is then subsequently removed by rinsing with tap water followed by a distilled water rinse. While the sheet is still wet, a solution of a wetting agent such as Kodak "Foto-Flo" Brand wetting agent is added to promote uniform wetting during subsequent treatments. In an alternative embodiment, rolls of aluminum foil may be continuously processed via electrolytic techniques, mechanical scrubbing or the like. All that is required is that a clean, residue-free aluminum surface be present prior to further treatment.

The antireflecting layer 20 is desirably formed on the cleaned and uniformly wet sheet 12 by placing it in a steam chamber and hot steaming it at a temperature between 85° and 98° C. at atmospheric pressure for a period of 5 to 15 minutes such that a microstructured boehmite aluminum oxide surface is formed on the sheet. Preferably, the oxidized aluminum sheet is then removed from the steam chamber, rinsed with distilled water, followd by a rinse with analytical grade isopropyl alcohol and is air dried, thereby further improving such surface characteristics as relate to the adherence of additional coatings, etc.

The antireflecting surface of boehmite (hydrated aluminum oxide) is characterized by a plurality of randomly positioned leaflets which extend from the surface of the aluminum foil a distance of not less than 20 nm, and the bases of which contact the bases of substantially all adjacent leaflets. The total reflectance of light normally incident on such a surface is less than one percent.

A luminous sheet such as a layer 14 containing phosphor particles 16 in an organic binder 18 is then coated onto the microstructured layer 20. For example, a 9:1 mixture by weight of $Gd_2O_2S$:Tb in an acrylic binder, such as Elvacite 2041, manufactured by E. I. DuPont, Inc., may be prepared in a conventional manner and coated onto the structured layer with a flat knife coater to provide a final thickness of approximately 75 μm (3 mils), after which a protective topcoat 22 of PVC or the like is similarly coated thereover. Such a composition provides an excellent screen for the conversion of x-ray to visible light, in which the light emitted is primarily at a wavelength of approximately 545 nm.

Figure 2:
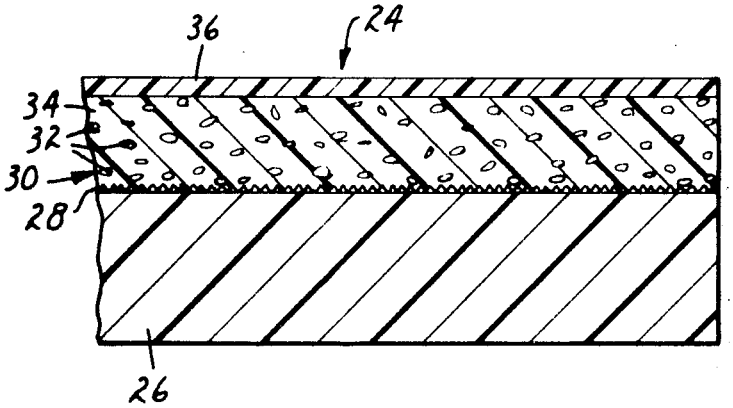
FIG. 2 is a cross-section of another embodiment of the screen of the present invention.

In an alternative embodiment shown in FIG. 2, the x-ray intensifying screen 24 includes a support layer of a 250 μm (10 mil) polyester sheet 26, an antireflecting layer 28, a luminous sheet 30, consisting of fluorescent particles 32 in an organic binder 34, and a protective topcoat 36.

In such an embodiment, in order to form the antireflecting layer 28, the polyester sheet 26 is first provided with an approximately 50 nm thick aluminum thin-film via conventional evaporation deposition. Very similar results are obtained with aluminum thin-films ranging in thickness between 15–100 nm. The aluminum thin-film is then completely coverted to a thicker, microstructured boehmite layer via exposure to steam in the manner described above. The resulting boehmite layer is then approximately 200 nm thick, has the same structural features as that formed on Al foil, and also exhibits an increased transmissivity corresponding to the reduction in reflectance. Where the aluminum thin-film varies between 15–100 nm, the converted boehmite layer may typically range in thickness between 50–500 nm. Such a converted boehmite structure again possesses a total reflectivity of less than one percent.

The luminous sheet 30 is then applied onto the microstructured layer 28. In one example, a mixture of $CaWO_4$ and a binder of ethyl cellulose Type N-100, manufactured by Hercules, Inc., was knife-coated onto the layer 28 to provide a coated thickness of approximately 75 μm. Such a phosphor provides optical emission centered at about 420 nm. Similarly, other phosphors may be selected according to techniques well known to those skilled in the art, in order to provide emitted light at a particularly desired wavelength. Likewise, a variety of other polymeric film forming binders may be used. The construction is then preferably provided with a protective topcoat 36 by applying a 12 μm layer of polyvinyl chloride, or the like to complete the screen.

It has been found that binders such as the ethyl cellulose Type N-100 utilized in the above example may not exhibit adequate adhesion to many substrates. The boehmite microstructure is preferably utilized in the present invention in that it also functions as an excellent primer to which the binders are securely bound. Other binders, including fluorocarbon based polymers such as Kel F Brand Type 827, manufactured by Minnesota Mining and Manufacturing Company, which have heretofore been undesirable due to the low degree of adherence to typical substrates may now be selected.

The improvement in resolution associated with the use of such a microstructured layer between the support layer and the luminous sheet is particularly evident when such a construction is compared with the resolution obtained with other types of underlayer constructions. For example, similar constructions utilizing $Gd_2O_2S$:Tb phosphor/binder mixtures were coated at a 75 μm thickness onto underlayers having a boehmite microstructured surface, an uncoated polyester sheet and a polyester sheet coated with a reflective layer of $TiO_2$. The resolution for the resultant screen containing a boehmite antireflecting surface was observed to be in excess of 7.1 line pairs per millimeter. That prepared on the uncoated polyester sheet was 6.3 line pairs per millimeter, while that including the $TiO_2$ reflecting layer was 5.6 line pairs per millimeter. The reduced resolution of $TiO_2$ sample was, as would be expected, offset by an increase in the relative speed. Thus, relative to the speed of the boehmite containing screen, taken to be zero on a log E scale for purposes of comparison, the $TiO_2$ containing screen had a relative speed of +0.2, while the screen including a plain polyester substrate had a relative speed of +0.1. No attempt was made to optimize the fluorescent particle size in order to obtain the ultimate resolution possible in these tests. However, the same phosphor, and thus the same particle size was used on the various based materials. Only the base underlayer and the surface treatment differed between the three samples. Standard commercial medical x-ray film such as 3M Brand Trimax XD was utilized to record the optical image from which the resolution was determined.

Similar results are obtained when other phosphors such as $CaWO_4$ are utilized, even though the wavelength of the optical emission is significantly shifted. The fact that the microstructured surface behaves in a similar nonreflective manner over widely separated wavelengths lends great flexibility to tailoring image conversion screens to a variety of application areas, since the same underlayer construction and processing conditions may be used regardless of the selected phosphor. Thus, screens with special antireflective layers prepared as described above may be useful in a number of areas in radiography requiring high image quality such as high resolution medical radiography and dental radiography as well as industrial applications.

Figure 3:
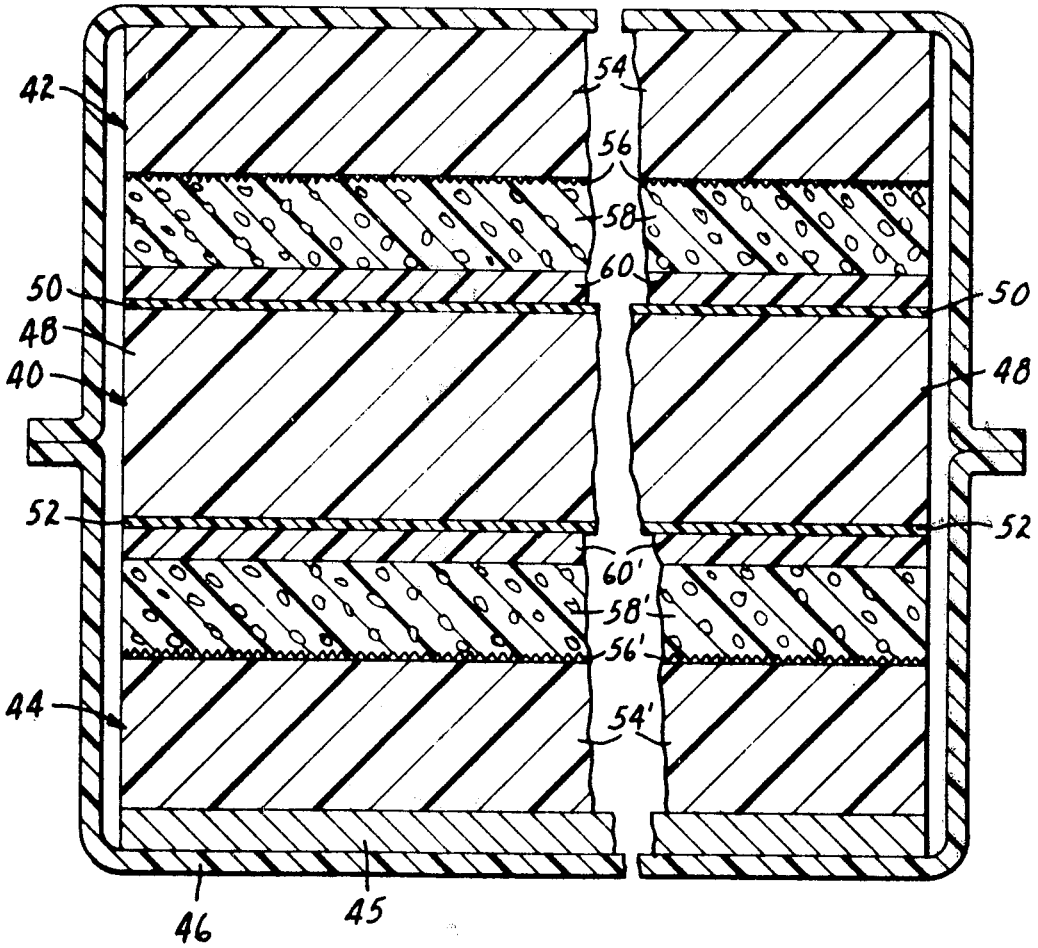
FIG. 3 is a cross-section of a film pack including an intensifying screen as shown in FIG. 1 or 2.

As shown in FIG. 3, the image intensifying screens of the present invention may be included together with light sensitive film to provide an assembled film-pack such as may preferably be employed in dental or industrial radiographic applications. Such a construction preferably includes laminate consisting of a photographic medium 40, intensifying screens 42 and 44, and an x-ray absorbing layer 45, such as lead foil, within an opaque envelope 46. In this embodiment, the photographic medium 40 includes a support layer 48, coated on both surfaces with 2–15 μm thick layers of photographic emulsion 50 and 52, respectively. Such a double coated photographic medium is commercially available as Type AA radiographic film manufactured by Eastman Kodak Company. Other commercial media designed for dental use such as Kodak Brand Ultraspeed film or 3M Brand Trimax XD x-ray films may similarly be included.

A double coated film 40 is desirably used, in that x-rays directed toward the top surface of the screen 42 pass through both intensifying screens 42 and 44 and the film 40. Light emitted by each screen thus exposes the emulsion layer 50 or 52 adjacent the respective screen, and provides twice the image density for a given exposure. X-rays incident on the first screen 42 and passing also through the screen 44 are then finally substantially absorbed by the absorbing layer 45 to prevent further x-ray exposure. Similarly, single coated film may be used in a film-pack together with a single intensifying screen.

In industrial radiographic applications in particular, the radiation absorbing layer 45 is optional and may be eliminated. Depending upon the type and energy of radiation to be directed thereat, such a layer may vary in thickness between 50 μm–1 mm and may be formed of Pb foil or other metals. In many instances, such layers are particularly desirably included in order to attenuate lower energy, scattered radiation, which is more effective in exciting the phosphors within the intensifying screens.

The intensifying screens 42 and 44 shown in FIG. 3 are substantially like those described in conjunction with FIGS. 1 and 2 hereinabove and comprise a support layer 54 and 54' respectively, antireflecting surfaces 56 and 56', and luminescent sheets 58 and 58'. Protective topcoats 60 and 60' are also optionally included.

The assembly of film 40, screens 42 and 44, and absorbing foil 45 are then sealed within an opaque black polyethylene envelope 46, such that the film-pack may be handled and exposed to imaged x-rays without concern for inadvertent light exposure. After x-ray imaging is completed, the film-pack may be opened and the photographic medium 40 developed in a conventional manner.

In the preferred embodiments described above, the antireflecting surfaces have been provided of a boehmite microstructured layer. Other microstructured surfaces may be advantageously provided such as are known to those skilled in the art. For example, it is known to provide antireflecting surfaces by treating glass surfaces with hydrofluoric acid to provide a skeletonized surface. Such a skeletonized antireflecting surface may be used directly as the support layer onto which a luminous screen may be coated. Such a skeletonized glass surface, as well as a boehmite surface, may be further processed to provide a master surface from which the microstructured surface is replicated into thermoplastic sheets or like constructions in a conventional manner. The microstructured surfaces of the thermoplastic sheets may then be directed coated with a luminous layer in the manner similar to that described above. Alternatively, mixtures of fluorescent particles and binders may be directed coated onto such master surfaces and subsequently stripped therefrom, such that the microstructured surface is directly formed within the luminous sheet and the support layer thus eliminated altogether. Other techniques for providing such microstructured surfaces as are known to those skilled in the art may also be used. While particulate luminous screens are especially desired in that the particulate nature of the screen minimizes lateral diffusion and hence lower resolution in the ultimate images, other screens such as evaporated phosphor layers and the like may be provided as desired.

Likewise, while the preferred embodiments described above have been directed to intensifying screens wherein a light image is directly provided, similar constructions may be utilized in light amplifying devices in which a photo-emitting layer is included over the luminous layer such that electrons are emitted in an imagewise pattern in response to the emission of light from the luminous layer, which electrons are subsequently accelerated toward appropriate screens or targets as are known in the art. Also, the invention is not limited to intensifying screens useful solely for x-ray intensifying or amplifying purposes and may be used in intensifying images carried in other types of radiation. Further, although specific materials and antireflecting layers are described and illustrated hereinabove, it is clear that all of the constructions may be varied to some extent, particularly in view of the fact that the variables are somewhat interdependent. Thus, the particular structural embodiments and particular methods of forming the antireflecting layers set forth herein are merely exemplary and are not definitive of the scope of the invention. Rather, the specific novelty and scope of the invention is defined in the appended claims.

Having thus described the present invention, what is claimed is:

1. A process for forming image converting screens comprising (a) preparing a support layer having a substantially planar surface of substantially non-oxidized aluminum, (b) converting a surface layer of said aluminum to boehmite by exposing said layer to steam at a temperature between 85° and 98° C. at atmospheric pressure for 5–15 minutes, to form said boehmite as a plurality of closely spaced and randomly positioned discrete leaflets of varying heights and shapes, which leaflets extend from the aluminum surface a distance of not less than 20 nm and the bases of which contact the bases of substantially all adjacent leaflets to provide a total reflectance of normally incident light of less than one percent, and (c) coating onto the boehmite leaflets a layer of fluorescent particles and polymeric binder.

2. A process according to claim 1, wherein said preparation of the support layer comprises abrading the surface of a sheet of aluminum foil with fine grade abrasive paper, cleaning the surface to remove residue therefrom and coating the surface with a wetting agent to promote uniform conversion to boehmite.

3. A process according to claim 1, wherein said preparation of the support layer comprises providing a substantially transparent sheet material and depositing a layer of aluminum at least 5 nm thick thereon.

* * * * *